United States Patent [19]

Foraison et al.

[11] 4,407,780

[45] Oct. 4, 1983

[54] REDUCTIVE STRIPPING OF URANIUM VALUES FROM WET-PROCESS PHOSPHORIC ACID

[75] Inventors: Dominique Foraison; Alain Leveque, both of Paris, France

[73] Assignee: Rhone-Poulenc Industries, Paris, France

[21] Appl. No.: 152,417

[22] Filed: May 22, 1980

[30] Foreign Application Priority Data

May 22, 1979 [FR] France ..... 79 12957

[51] Int. Cl.[3] ..... C01G 43/00

[52] U.S. Cl. ..... 423/10; 423/8

[58] Field of Search ..... 423/10

[56] References Cited

U.S. PATENT DOCUMENTS

| | | | |
|---|---|---|---|
| 2,859,092 | 11/1958 | Bailes | 423/10 |
| 3,711,591 | 1/1973 | Hurst | 423/10 |
| 3,737,513 | 6/1973 | Wiewiorowski | 423/10 |
| 3,835,214 | 9/1974 | Hurst | 423/10 |
| 3,966,872 | 6/1976 | Sundar | 423/10 |
| 3,966,873 | 6/1976 | Elikan | 423/10 |
| 4,002,716 | 1/1977 | Sundar | 423/10 |
| 4,105,741 | 8/1978 | Wiewiorowski | 423/10 |
| 4,332,776 | 6/1982 | Stana | 423/10 |

FOREIGN PATENT DOCUMENTS

| | | | |
|---|---|---|---|
| 2070722 | 9/1971 | France | 423/10 |

OTHER PUBLICATIONS

Ornl-Tm-2522, Oak Ridge National Lab., (1969).

*Primary Examiner*—Robert Gerstl

*Attorney, Agent, or Firm*—Burns, Doane, Swecker & Mathis

[57] ABSTRACT

Uranium values are recovered from a wet-process phosphoric acid solution by extracting said solution with a first organic extractant, reductively stripping the resulting first organic phase of its uranium values with a strip solution including and in which ferrous ion is utilized to reduce uranyl ions in said first organic phase to uranous ions therein, disengaging the strip solution from said first organic extractant and oxidizing same to convert the uranous ions therein to uranyl ions, next extracting said oxidized strip solution and the uranium values contained therein with a second organic extractant, and then stripping said uranium values from the resulting second organic phase, said recovery featuring (i) washing with an iron-free aqueous wash solution, and upstream of the reductive stripping thereof, the organic phase resulting from said first extraction, and (ii) utilizing effluent, iron-free wash solution from the step (i) to wash the organic phase resulting from said second extraction and concomitantly to strip any iron values therefrom, upstream of the stripping of the uranium values therefrom.

20 Claims, 1 Drawing Figure

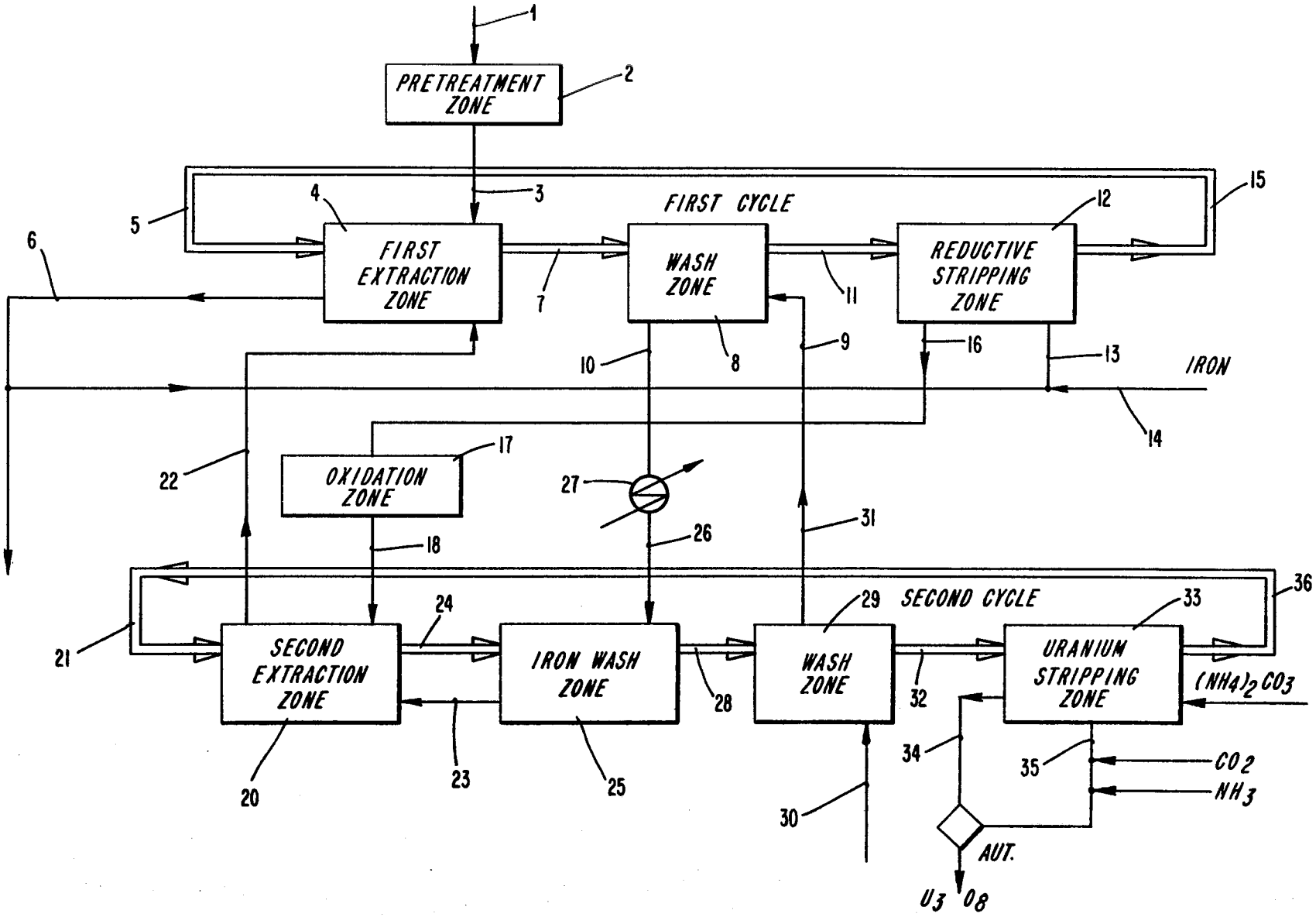
PRETREATMENT ZONE
FIRST EXTRACTION ZONE
WASH ZONE
REDUCTIVE STRIPPING ZONE
FIRST CYCLE
IRON
OXIDATION ZONE
SECOND EXTRACTION ZONE
IRON WASH ZONE
WASH ZONE
URANIUM STRIPPING ZONE
SECOND CYCLE
$(NH_4)_2CO_3$
$CO_2$
$NH_3$
AUT.
$U_3O_8$

REDUCTIVE STRIPPING OF URANIUM VALUES FROM WET-PROCESS PHOSPHORIC ACID

BACKGROUND OF THE INVENTION

1. Field of the Invention:

The present invention relates to an improved process for the recovery of uranium values contained in phosphoric acid, and, more especially, to the recovery of uranium from wet-process phosphoric acid produced by the acidulation of phosphate rock, via liquid-liquid extraction.

2. Description of the Prior Art:

It is well known to this art to recover uranium from aqueous solutions which contain the uranium at low levels of concentration, by separating it from the other constituents (which themselves can be diverted to valuable end uses in many instances) of the treated ores, by means of a combination of liquid-liquid extractions and chemical treatments, the goal of which is to isolate the uranium and recover it in the form of the oxide $U_3O_8$ in a high state of purity, which can be used as a nuclear fuel source. These uranium recovery processes are applicable to ores such as phosphate rock which also yield phosphoric acid, or ores of various other origins, having a greater or lesser content of uranium, in most cases the uranium being present in oxide form. Such processes generally comprise treating or acidulating the ore by means of a strong concentrated acid, such as sulfuric, phosphoric, hydrochloric or nitric acid, to provide an aqueous solution which contains uranyl ions in a highly dilute state, in conjunction with other contaminating ions from which the uranium is recovered.

A typical example of a process for the recovery of uranium from wet-process phosphoric acids is described in U.S. Pat. No. 3,711,591 to Hurst and Crouse. This process features two successive extraction cycles. In the first cycle, the uranium of valency +6 in the impure phosphoric acid is extracted by means of a first organic extractant comprising an inert diluent, a primary extractant, i.e., di(2-ethylhexyl)phosphoric acid (HDEHP, DEPA or D2EPHA), and a synergistic extractant therefor, i.e., trioctylphosphine oxide (TOPO), at selected concentrations in the diluent. After separation of the phases, the impure acid which is exhausted in respect of uranium is returned to the phosphoric concentration unit while the organic phase which is charged with hexavalent uranium (VI) is reductively stripped with an aqueous solution of phosphoric acid, at a moderate flow rate, said aqueous solution containing a reducing agent based upon metallic iron or a ferrous iron (II) salt, thereby re-extracting tetravalent uranium (IV) in the aqueous phase. The organic phase which is depleted of its uranium values, after separation of the phases, is recycled to the extraction step of the impure acid, typically oxidized wet-process acid.

In the second cycle of this process, the aqueous solution of phosphoric acid, which has a high content of uranium and iron, produced as described above, is subjected to a second continuous extraction, after re-oxidation of the uranium to a valency of +6, by means of a second organic extractant of the same nature as the first extractant, to thereby produce an organic phase which is rich in uranium (VI) and an exhausted aqueous phase which is recycled to the re-extraction operation of the first cycle or which is diverted to the phosphoric concentration unit. The aforesaid organic phase is washed with water and then treated to recover therefrom the uranium by precipitation, in the form of a mixed carbonate of uranium and ammonium, i.e., ammonium uranyl tricarbonate (AUT). The resulting uranium-depleted organic phase is recycled. The AUT is thence conveniently calcined into $U_3O_8$.

Industrial use of this process requires that, in order to achieve effective re-extraction of the uranium from the first extractant, the concentration of iron in the aqueous solution of phosphoric acid must be relatively high, on the order of 15 to 30 g/liter of aqueous solution. Under these conditions, and in spite of a very low degree of extraction in respect of the iron by the organic phase in the second cycle, the uranium produced contains substantial amounts of iron which can be up to 4 to 5%. There exists, therefore, serious need for an improved process which enables recovery of uranium which is substantially free from iron under economically viable conditions.

See also, generally, U.S. Pat. Nos. 2,859,092, 3,737,513, 3,835,214 and 4,105,741, and French Pat. Nos. 2,070,722, 2,241,620, 2,249,841 and 2,249,961.

SUMMARY OF THE INVENTION

Accordingly, a major object of the present invention is the provision of an improved process for the recovery of uranium (VI) from an impure phosphoric acid comprising, in a first cycle, extracting the impure acid with a first organic extractant comprising a dialkylphosphoric acid, a trialkylphosphine oxide and an inert diluent, and then separating the phases; next reductively stripping the aforementioned uranium-rich organic phase with an aqueous solution of phosphoric acid containing reductant iron (II) ions, thereby to extract the reduced uranium (IV) into said aqueous phase, then separating the phases and recycling the exhausted organic phase to the impure acid extraction operation; thence, in a second cycle, extracting the aforesaid aqueous phase after oxidation thereof, with a second extractant comprising an inert diluent, a dialkyl phosphoric acid and, if appropriate, a synergistic extractant therefor, such as a trialkylphosphine oxide, dibutylbutyl phosphonate or a trialkylphosphate, thereby to recover, after separation of the phases, an aqueous phase which is exhausted in respect of uranium and a uranium-rich organic phase from which the uranium is recovered after a washing operation with water and before recycling of said second extractant; said process being characterized in that, prior to the step of washing with water, said uranium-rich organic phase is treated with an aqueous solution of purified phosphoric acid which is substantially free of iron, said solution originating from the aqueous washing of the organic extractant of the first cycle between the step of extracting the impure acid and the step of re-extracting the uranium, and after having concentrated same.

BRIEF DESCRIPTION OF THE DRAWING

The FIGURE of Drawing is a schematic flow sheet of the improved reductive stripping of uranium values according to the invention.

DETAILED DESCRIPTION OF THE INVENTION

More particularly according to the invention, and with reference to the accompanying FIGURE of Drawing, the impure phosphoric acid is characteristically a crude wet-process phosphoric acid produced by the acidulation of phosphate rock with sulfuric acid. After filtration of the by-product gypsum, the crude phosphoric acid liquor is introduced via conduit 1 into typical pretreatment zone 2 and there subjected to such conventional operations as stabilization, concentration, etc., and is drawn-off therefrom via line 3, in a $P_2O_5$ concentration by weight which is usually from 25 to 40%, the uranium content usually ranging from 80 to 250 mg/liter and the iron content thereof being on the order of 3 to 10 g/liter. The aforenoted acid is fed to an extraction zone 4 which generally comprises a battery of mixer-settlers, a filled column or a pulsed column, either countercurrent or cocurrent to a first organic extractant introduced at 5 and which circulates in a closed circuit. The ratio between the flow rate of the impure acid and the flow rate of the organic extractant is typically from 0.5 to 5 and generally close to 2. The first organic extractant comprises a well-known and conventional inert organic diluent such as kerosene, a principal extractant selected from among the di(alkyl)-phosphoric acids and a synergist therefor selected from among the trialkylphosphine oxides. Typically, the preferred constituents of the overall extractant are di(2-ethylhexyl)phosphoric acid (HDEHP) and trioctylphosphine oxide (TOPO). The concentration of HDEHP in the extractant is generally from 0.1 M to 1.5 M, preferably approximately 0.5 M. The concentration of TOPO in the extractant is generally from 0.05 M to 0.5 M, preferably approximately 0.125 M.

At the outlet of the extraction zone 4, a solution of phosphoric acid which is depleted in uranium values is recovered via line 6, while an organic phase which is rich in uranium (VI) exits via line 7. The effluent organic phase is next fed into a wash zone 8 comprising one or more mixer-settlers, where it is washed with an aqueous solution 9 prepared as will be described hereinbelow. Alternatively, the flow 9 introduced into the zone 8 can be pure water. The ratio between the rate of flow of the stream 9 and that of the flow 7 generally ranges from 1/100 to 1/10, and preferably is approximately 1/50. An aqueous wash solution which is enriched in phosphoric acid and which is virtually completely, freed of iron values outlets the zone 8. The iron content of the aqueous solution does not usually exceed 30 mg/liter. The flow 10 is then treated as described hereinafter in the description relating to the second cycle of the operation. Also issuing from the wash zone 8 is the organic phase 11 which is fed into a uranium re-extraction zone 12 which usually comprises a battery of mixer-settlers, a pulsed column or a filled column, and wherein it is either countercurrently or cocurrently treated with an aqueous solution of phosphoric acid, introduced via the line 13, and containing iron (II) ions, the ratio between the rate of flow of the stream 13 and that of the flow 11 generally ranging from 0.015 to 0.1, and preferably approximately 0.025. The content by weight in respect of $P_2O_5$ generally ranges from 28 to 45%, preferably about 35%, and the amount of iron (II) ion generally ranges from 10 to 40 g/liter, preferably about 25 g/liter. In a preferred alternative embodiment, the stream 13 is produced by drawing off a portion of the stream of uranium-depleted impure acid 6 which issues from the extraction zone 4, the iron (II) ions being produced by dissolution of metallic iron which is introduced through line 14.

An organic phase which is depleted in uranium and which forms the recycled feed 5 exits the zone 12 at 15, while an aqueous stream which is enriched in uranium (IV) values and which also contains iron ions outlets the zone 12 via line 16. The stream 16 is then used as feed to a zone 17 in which it is oxidized by means of an oxidizing agent such as hydrogen peroxide, air or a chemical oxidant such as a chlorate, or by conveying same into the anodic compartment of a DC voltage separator-type electrolytic cell from which it is drawn off via line 18 to become feed for the second cycle.

In the second cycle, the stream 18 is used to supply an extraction zone 20 comprising a battery of mixer-settlers, in conjunction with a flow 21 comprising the second organic extractant. The second organic phase typically comprises an inert diluent, a dialkylphosphoric acid such as HDEHP and, if appropriate, a synergistic extractant, preferably TOPO. However, the molar concentrations of the principal extractant and the synergistic extractant in the inert diluent may be substantially different therein than those in the organic phase comprising the first cycle. Thus, the concentration in respect of HDEHP is typically preferably about 0.3 M and the concentration in respect to TOPO is typically preferably about 0.075 M. The ratio between the rate of flow of the stream 18 and the flow rate of stream 21 typically varies from 0.1 to 5, and is preferably about 0.5.

Likewise, an aqueous stream 23 is introduced into the zone 20, said stream 23 emanating from the purification zone 25, as will be described hereinafter, and containing phosphoric acid, uranium and iron ions. An aqueous phase which is exhausted of its uranium values exits the zone 20 via line 22, and advantageously is recycled to supply the first extraction zone 4, while an organic stream 24 rich in uranium issues from the zone 20. The stream 24 is then used as feed for the purification zone 25 for purification with respect to the iron values, and typically comprising a battery of mixer-settlers where it is treated by means of the stream 26 of an aqueous solution of phosphoric acid, which is produced by concentration in an evaporator 27 of the stream 10 emanating from the zone 8 for the recovery of phosphoric acid containing a very small amount of iron, as described hereinbefore. In the evaporator 27, the content by weight of $P_2O_5$ in the stream 10 is raised from a value typically ranging from 2 to 15%, preferably about 10%, to a content in the feed 26 which is typically about 30%, this being necessary in the battery 25 for purification of the organic stream 24 with respect to the iron values therein. The zone 25 preferably comprises from 1 to 10 mixer-settlers and the ratio between the rate of flow of the stream 26 and that of the flow 24 ranges from 0.025 to 0.3, and preferably is 0.1. The aqueous solution of acid which is rich in iron and uranium values is utilized as feed for zone 20, via line 23, together with the feed 18. After traversing the zone 25, the organic phase issues therefrom by way of the conduit 28, with a reduced iron content, the weight ratio Fe/U characteristically being lower than 0.4%.

The flow through line 28 is then utilized as feed to a wash zone 29 comprising a plurality of mixer-settlers and wherein it is treated by means of a stream of pure water entering the system at line 30, thereby to recover a substantial fraction of the phosphoric acid present in the stream 28. The wash water drawn off at 31 can be combined with the depleted crude acid or else it can be utilized as feed for and to the zone 8 for the recovery of $P_2O_5$ of the first cycle, and thus can form the stream 9.

The purified and uranium-rich organic phase is withdrawn via line 32 and is then treated for recovery of the uranium therefrom. In a preferred embodiment, the flow 32 is treated with an ammonium carbonate solution in a single-stage apparatus 33, whereby AUT is precipitated. After separation of the phases, the aqueous AUT suspension 34 is filtered, and the filter cake is calcined to produce $U_3O_8$ in a Fe/U ratio of less than 0.4%. The filtration mother liquor is recycled via line 35 after the addition of $CO_2$ and $NH_3$ to adjust the strength of the solution in the apparatus 33. The organic phase issues in a depleted condition at line 36 and is recycled to the zone 20.

The process according to the invention enables production of a uranium oxide in a high state of purity vis-a-vis any iron contaminants, by means of treatment with a purified phosphoric acid which is substantially free from iron in the course of the second cycle, which purified acid is a product of the first cycle, and without there being any need for any external make-up or additions.

In the subject process, the operating temperatures are not critical, although in practice same typically range from 20° to 60° C.

In order to further illustrate the present invention and the advantages thereof, the following specific example is given with reference to the accompanying Figure of Drawing, it being understood that same is intended only as illustrative and in nowise limitative.

EXAMPLE

A pre-treated, impure wet-process phosphoric acid containing 30% of $P_2O_5$, 110 mg/liter of uranium and 8 g/liter of iron was introduced via line 3 into an extraction battery 4 comprising five mixer-settlers, at a flow rate of 100 liters/hour. A stream 5 of 50 liters/hour of recycled organic phase comprising a 0.5 M concentration of HDEHP and a 0.125 M concentration of TOPO was also introduced into the battery 4. The aqueous flow 6 issuing from the battery was conveyed to the concentration stage. The organic stream 7 contained 160 mg/liter of iron. Such stream was treated in a single stage in a zone 8 for recovery of $P_2O_5$ by means of a solution 9 of phosphoric acid recycled from the wash zone in the second cycle, at a flow rate of 0.91 liter/-hour. Drawn off was a stream of phosphoric acid containing 10% $P_2O_5$ and 30 mg/liter of iron, which was conveyed to the evaporator 27 to produce an aqueous flow 26 containing 30% of $P_2O_5$ and 120 mg/liter of iron, at a flow rate of 0.25 liter/hour. From the wash zone 8, the organic phase was transferred into the uranium regeneration zone 12 comprising four mixer-settlers, where it was countercurrently treated with a stream 13 of phosphoric acid containing 30% of $P_2O_5$ and 25 g/liter of iron (II) ion, at a flow rate of 1.35 liter/hour. The depleted organic phase was recycled to the extraction zone 4 and the aqueous phase 16 exiting the zone 12 contained 6 g/liter of uranium. After oxidation by means of hydrogen peroxide, at 17, the aqueous phase 18 together with the aqueous phase 23 were treated in an extraction battery 20 of four mixer-settlers by means of a kerosene phase 21 having a 0.3 M concentration of HDEHP and a 0.075 M concentration of TOPO, at a flow rate of 2.4 liters/hour. The resulting organic phase 24 contained 170 mg/liter of iron and 4 g/liter of uranium. The aqueous phase was recycled, via 22, to the extractor comprising the first cycle.

The organic phase 24 was then treated in a purifier battery 25 comprising six mixer-settlers by means of the above-described aqueous phase 26. The effluent of this operation was an organic phase 28 containing 3.5 g/liter of uranium and 1.3 mg/liter of iron, defining a Fe/U ratio of approximately 0.4%.

The phase 28 was then washed with pure water at a flow rate of 0.91 liter/hour in a battery 29 of three mixer-settlers, the wash water 31 being recycle feed to the wash battery 8 in the first cycle. The uranium was then recovered from the purified and washed phase 32 in an apparatus 33 comprising a mixer-settler, by means of a 2 M aqueous solution of $(NH_4)_2CO_3$. Thence, after calcination of the AUT precipitate, the resulting product was a $U_3O_8$ displaying a Fe/U ratio of 0.4%.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. In a process for the recovery of uranium values from a wet-process phosphoric acid solution which comprises extracting said solution with a first organic extractant, reductively stripping the resulting first organic phase of its uranium values with a strip solution including and in which ferrous ion is utilized to reduce uranyl ions in said first organic phase to uranous ions therein, disengaging the strip solution from said first organic extractant and oxidizing same to convert the uranous ions therein to uranyl ions, next extracting said oxidized strip solution and the uranium values contained therein with a second organic extractant, washing the organic phase resulting from the second extraction with an aqueous solution of phosphoric acid to strip concomitantly any iron values therefrom, and thence stripping said uranium values from the resulting second organic phase, the improvement comprising (i) washing with an iron-free aqueous wash solution, and upstream of the reductive stripping thereof, the organic phase resulting from the first extraction, and (ii) utilizing effluent, iron-free aqueous wash solution, containing phosphoric acid, from the step (i) to wash the organic phase resulting from the second extraction and concomitantly to strip any iron values therefrom, upstream of the stripping of the uranium values therefrom.

2. The process as defined by claim 1, said first organic extractant comprising an inert diluent and a dialkylphosphoric acid.

3. The process as defined by claim 2, said first organic extractant further comprising an extraction synergist selected from the group consisting of a trialkylphosphine oxide, dibutylbutylphosphonate and a trialkylphosphate.

4. The process as defined by claim 3, said first organic extractant comprising an inert diluent, di(2-ethylhexyl)-phosphoric acid and trioctylphosphine oxide.

5. The process as defined by claim 4, said second organic extractant also comprising an inert diluent, di(2-ethylhexyl)phosphoric acid and trioctylphosphine oxide.

6. The process as defined by any of claims 1 to 5, further comprising pure water washing the organic phase effluent of said step (ii), also upstream of the stripping of the uranium values therefrom.

7. The process as defined by claim 6, wherein the effluent pure water wash solution is utilized as the step (i) iron-free aqueous wash solution.

8. The process as defined by any of claims 1, 4 or 5, wherein the step (ii) wash solution is concentrated prior to washing said organic phase resulting from said second extraction therewith.

9. The process as defined by claim 6, wherein the step (ii) wash solution is concentrated prior to washing said organic phase resulting from said second extraction therewith.

10. The process as defined by claim 7, wherein the step (ii) wash solution is concentrated prior to washing said organic phase resulting from said second extraction therewith.

11. The process as defined by claim 8, the stripping of the uranium values from said second organic extractant being with an aqueous solution of ammonium carbonate.

12. The process as defined by claim 9, the stripping of the uranium values from said second organic extractant being with an aqueous solution of ammonium carbonate.

13. The process as defined by claim 10, the stripping of the uranium values from said second organic extractant being with an aqueous solution of ammonium carbonate.

14. The process as defined by claim 1, said starting wet-process phosphoric acid solution having been concentrated to a content in $P_2O_5$ of from 25 to 40% by weight.

15. The process as defined by claim 8, wherein the washing step (i) is with pure water.

16. The process as defined by claim 10, the step (ii) wash solution comprising an aqueous solution of phosphoric acid.

17. The process as defined by claim 10, wherein the effluent wash solution of said step (ii), comprising an aqueous solution of phosphoric acid containing both uranium and iron values, is cycled as feed to said second extraction.

18. The process as defined by claim 17, wherein the aqueous phase of said second extraction is cycled as feed to said first extraction.

19. The process as defined by claim 18, the organic phases resulting after said disengaging and said ultimate stripping of uranium values being recycled to said first and second extractions, respectively.

20. The process as defined by claim 19, the aqueous phase phosphoric acid solution depleted in uranium values resulting from said first extraction being cycled as feed comprising said reductive strip solution.

* * * * *